US006976765B2

(12) United States Patent
Helenowski

(10) Patent No.: US 6,976,765 B2
(45) Date of Patent: Dec. 20, 2005

(54) ENCLOSURE FOR A LIGHT SOURCE

(76) Inventor: Jacek Helenowski, 4300 W. North Ave., Stone Park, IL (US) 60165

( * ) Notice: Subject to any disclaimer, the term of this patent is extended or adjusted under 35 U.S.C. 154(b) by 199 days.

(21) Appl. No.: 10/632,667

(22) Filed: Aug. 2, 2003

(65) Prior Publication Data

US 2005/0024856 A1 Feb. 3, 2005

(51) Int. Cl.[7] ..... F21S 8/00
(52) U.S. Cl. ..... 362/147; 52/28
(58) Field of Search ..... 362/145–153.1; 52/28

(56) References Cited

U.S. PATENT DOCUMENTS 1,505,625 A * 8/1924 Dearth ..... 40/565
1,709,202 A * 4/1929 Beldin ..... 40/564
2,225,961 A * 12/1940 Rundberg ..... 40/564
4,223,377 A 9/1980 Williams
4,453,202 A * 6/1984 Morris et al. ..... 362/147
4,848,017 A * 7/1989 Bailey et al. ..... 40/576
5,160,202 A 11/1992 Legare
D376,657 S 12/1996 Bohn
5,678,920 A 10/1997 Kerr
5,683,170 A 11/1997 Blaha
5,778,625 A 7/1998 Druffel et al.
5,833,351 A * 11/1998 Marsh ..... 362/145
5,851,061 A * 12/1998 Hegarty ..... 362/20
5,908,263 A * 6/1999 Conners et al. ..... 404/9
5,911,499 A * 6/1999 Stafford et al. ..... 362/240
5,943,827 A 8/1999 Okerlund
6,027,280 A * 2/2000 Conners et al. ..... 404/19
6,341,457 B1 1/2002 Aerts et al.
6,354,714 B1 3/2002 Rhodes
6,565,236 B1 * 5/2003 Davis, Jr. ..... 362/362
6,773,135 B1 * 8/2004 Packer ..... 362/145
6,874,919 B2 * 4/2005 Stokes et al. ..... 362/471

* cited by examiner

*Primary Examiner*—Stephen Husar
*Assistant Examiner*—Jason Han
(74) *Attorney, Agent, or Firm*—Susan L. Lukasik

(57) ABSTRACT

A light source is disposed in a cavity in an enclosure that supports a part of the wall. The enclosure may be disposed substantially within the wall, such that the enclosure does not provide an obstacle to those moving near the wall. Because the enclosure is capable of supporting a part of the wall, the enclosure may be substituted for one or more substructures of the wall, including, but not limited to, concrete blocks, cement blocks, bricks, cinder blocks, and combinations thereof. The enclosure may be disposed at most any height in the wall.

26 Claims, 4 Drawing Sheets

ENCLOSURE FOR A LIGHT SOURCE

FIELD OF THE INVENTION

This invention relates to illumination, including, but not limited to, illumination sources disposed in walls.

BACKGROUND OF THE INVENTION

Illumination of areas adjacent to walls of buildings and other structures may be provided by light sources mounted to the walls or attached to freestanding structures near the walls. Either light source provides an obstacle to those moving near the walls. In addition, the light may be placed at a location that is higher or further away from the area to be lighted, thus the illumination source must be brighter, and thus utilize more power, to provide the desirable level of illumination.

Accordingly, there is a need for a method and apparatus for illuminating an area on and/or near a wall without providing a significant obstacle next to the wall or requiring additional power to provide the desirable level of light.

DESCRIPTION OF A PREFERRED EMBODIMENT

The following describes an apparatus including an enclosure in which a light source is disposed and which supports a part of the wall in which the apparatus is described. The enclosure may be disposed substantially within the wall, such that the enclosure does not provide an obstacle to those moving near the wall. Because the enclosure is capable of supporting a part of the wall, the enclosure may be substituted for one or more substructures of the wall, including, but not limited to, concrete blocks, cement blocks, bricks, cinder blocks, and combinations thereof. Because of its supporting nature, the enclosure may be disposed at most any height in the wall, and thus provides more direct light to the desired area.

Figure 1:
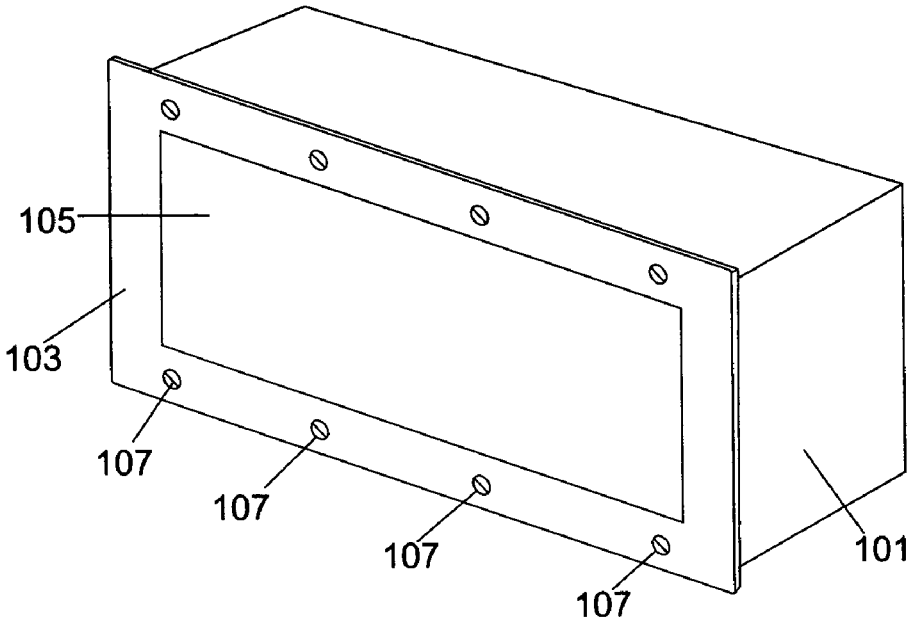
FIG. 1 is a perspective view of an enclosure for a light source with a cover plate in accordance with the invention.

A perspective view of an enclosure 101 for a light source with a cover plate 103 is shown in FIG. 1. The enclosure 101 is typically shaped to mate with an opening in a wall. The enclosure is designed such that it is capable of supporting a part of the wall. As shown in the figures, the enclosure 101 provides vertical support, such as through the side walls of the enclosure 101, and horizontal support, such as through the horizontal walls of the enclosure 101. Advantageously, the enclosure 101 may be the same size and shape as one or more substructures of the wall, such that the enclosure may be utilized instead of one or more substructures while the wall is built or substituted for one or more substructures after the wall is built. The substructures include, for example, concrete blocks, cement blocks, cinder blocks, and/or bricks. Advantageously, the enclosure 101 is strong enough to support the same amount of weight as the substructures replaced by the enclosure 101. Alternatively, the enclosure may be disposed in a poured wall, in which case the enclosure advantageously provides the same amount of support as the amount of wall displaced by the enclosure 101.

A cover plate 103 provides an access port to a cavity within the enclosure 101. The cover plate 103 is advantageously comprised of the same material as the enclosure 101. Alternatively, the cover plate 103 may be comprised of any material. The cover plate 103 supports and/or attaches a lens 105 to one end of the enclosure 101. One or more lenses 105 may be disposed along one or more openings in the cover plate 103. A light source illuminates the area outside the enclosure by emitting or directing light through the lens 105. The lens 105 is advantageously transparent, frosted, shaded, colored, and/or prismatic. The lens 105 need not be an optical lens. The lens 105 may be comprised of tempered glass or safety glass. The cover plate 103 is shown attached to the enclosure 101 by a plurality of fasteners 107.

Figure 2:
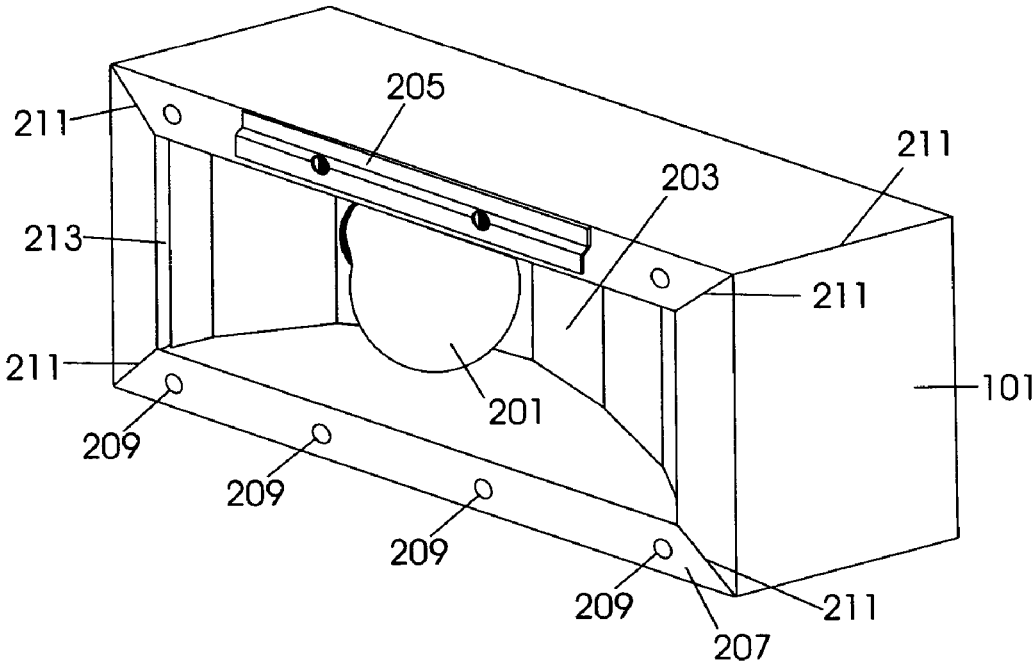
FIG. 2 is a perspective view of the inside of an enclosure for a light source in accordance with the invention.
Figure 8:
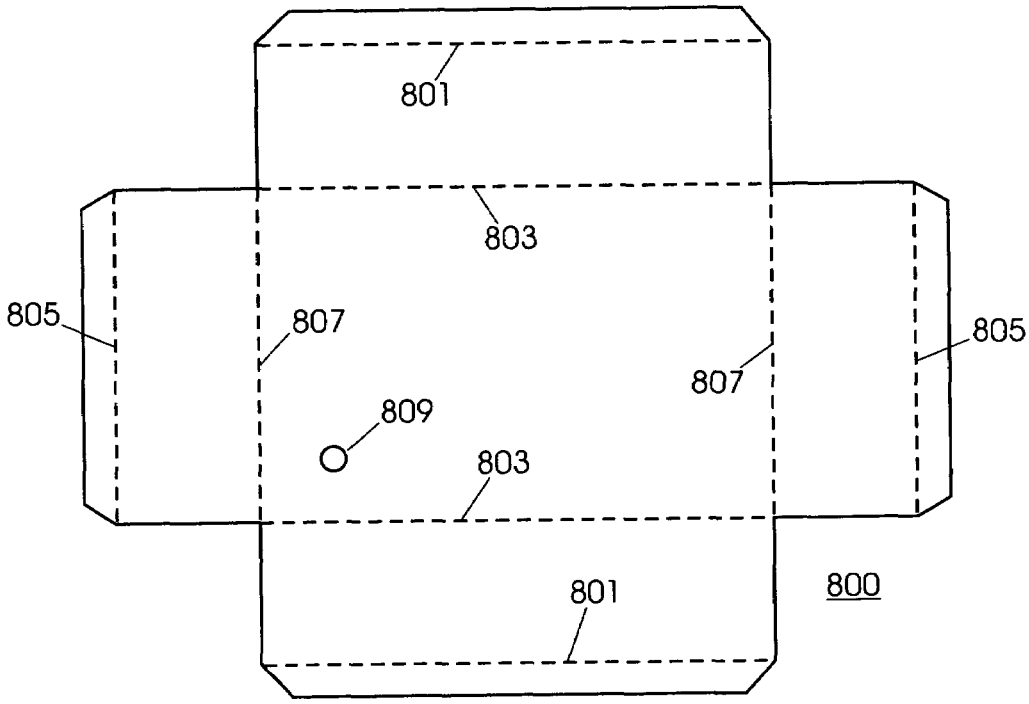
FIG. 8 illustrates a sheet of metal prior to being shaped into an enclosure in accordance with the invention.

A perspective view of the inside cavity of the enclosure 101 for a light source 201 is shown in FIG. 2. The light source 201 is shown mounted through an optional reflector 203 that focuses or directs the light through the opening of the enclosure 101. The reflector 203 may be fastened to the enclosure 101 with studs, screws, or other fastening devices. The lens 105 may optionally be held in place by one or more guides 205, such as the guide 205 shown attached to flange 207. The flange 207 has a plurality of holes 209, through which the cover plate 103 is fastened. The enclosure 101 is shown fashioned from a single piece of metal, such as shown in FIG. 8, and welded at the seems 211. The flange 207 is shown with a rectangular opening, although the opening may take on any size, shape, or orientation, and more than one opening may be provided. The interior wall of the enclosure 101 may be coated with or covered by a fire-resistant material 213, for example, gypsum board, neobestos, and so forth.

The light source 201 may be, for example, incandescent, cold cathode, neon, fluorescent, compact fluorescent, light emitting diodes (LEDs), plasma, electroluminescent (EL), and so forth, or any combination thereof. The light source 201 may be a single elongated bulb or a plurality of bulbs or LEDs. The light source 201 may provide one or more different colors, such as may be provided by bulbs of different colors, and/or the light source 201 may provide a variety of different lighting levels, such as may be provided by a dimmer switch. A switch may be provided to activate the light source 201. A motion-activated switch may be provided to activate the light source 201 when motion is detected near the light source 201. Advantageously, the light source 201 may provide light for an extended period of time, such as many thousands of hours, to avoid having to change the bulb too often. A light source 201 that is energy efficient by nature also provides advantage.

Figure 3:
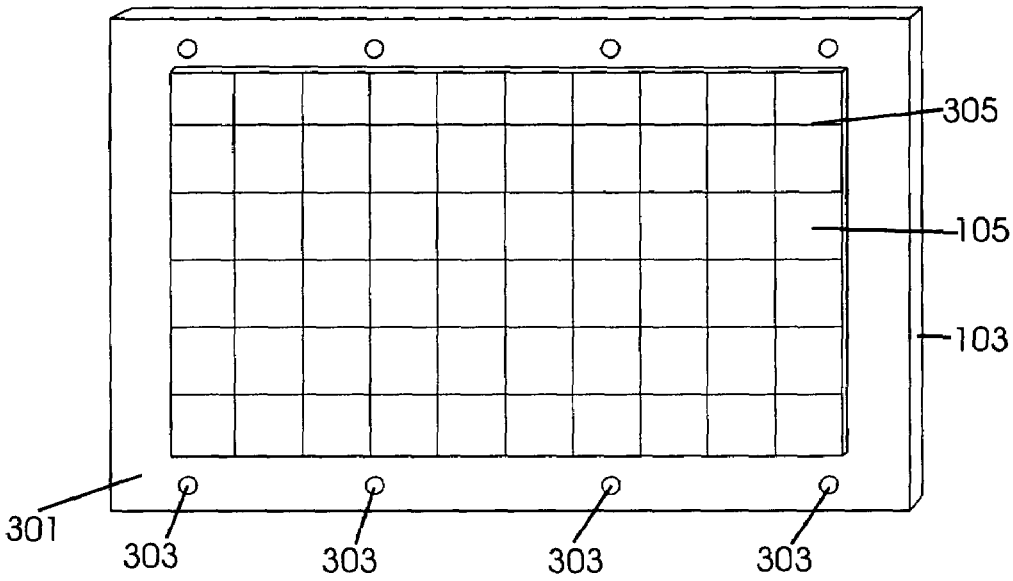
FIG. 3 is a view of a back side of a cover plate in accordance with the invention.

A view of a back side of the cover plate 103 is shown in FIG. 3. A gasket 301, such as an elastomeric, rubber, or other type of sealing material, is disposed on the back side of the cover plate such that the gasket 301 is disposed between the cover plate 103 and the enclosure 101 when the cover plate 103 is fastened to the enclosure 101, thereby providing resistance to weather. A plurality of holes 303 are disposed in the gasket 301 and the cover plate 103 such that the holes 303 align, and the fasteners 107 extend through the holes 303 into the holes 209 of the enclosure 209.

Figure 4:
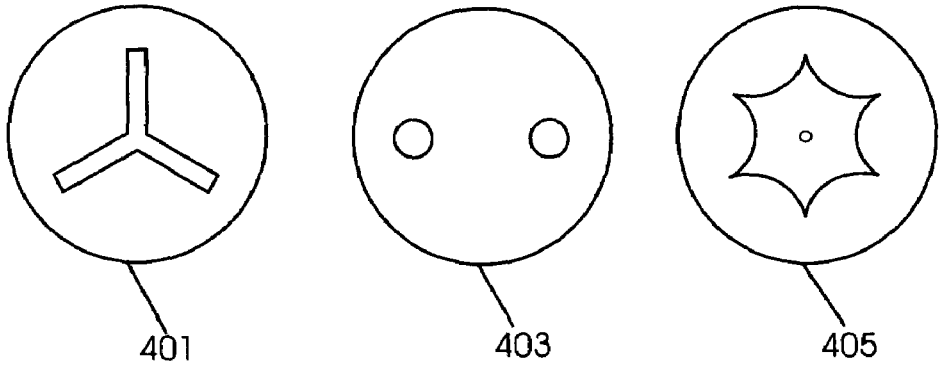
FIG. 4 illustrates the heads of a plurality of tamper-resistant fasteners in accordance with the invention.

The lens 105 is shown in FIG. 3 with a strengthening structure, such as wire or plastic for strength and/or reinforcement, disposed with or within the lens 105 in order to render the lens impact-shatter-resistant. The apparatus may optionally be made vandal-resistant, including impact-resistant features, such as a lens 105 comprised of shatter-resistant glass or plastic, a strengthening structure disposed with or within the lens 105, and tamper-resistant or access-resistant features, such as fasteners 107 having heads 401, 403, or 405 as shown in FIG. 4 with non-standard interfaces to fastening tools, such as screwdrivers with mating ends to the interfaces 401, 403, or 405.

The apparatus may be made to be explosion-resistant or explosion-proof. In such an apparatus, the enclosure 101, cover plate 103, and lens 105 are comprised of materials capable with withstanding an explosion, and are welded or otherwise fashioned such that any seems 211 or folds also withstand an explosion. The gasket 301 is an explosion-resistant gasket as available commercially, and the fitting for the electrical wiring for the light source 201 is a threaded fitting as installed in the opening 809 as shown in FIG. 8. The interfaces between the enclosure 101, cover plate 103, and lens 105 are also designed to withstand an explosion. The fasteners 107 are threaded and their holes 209 are tapped.

Figure 5:
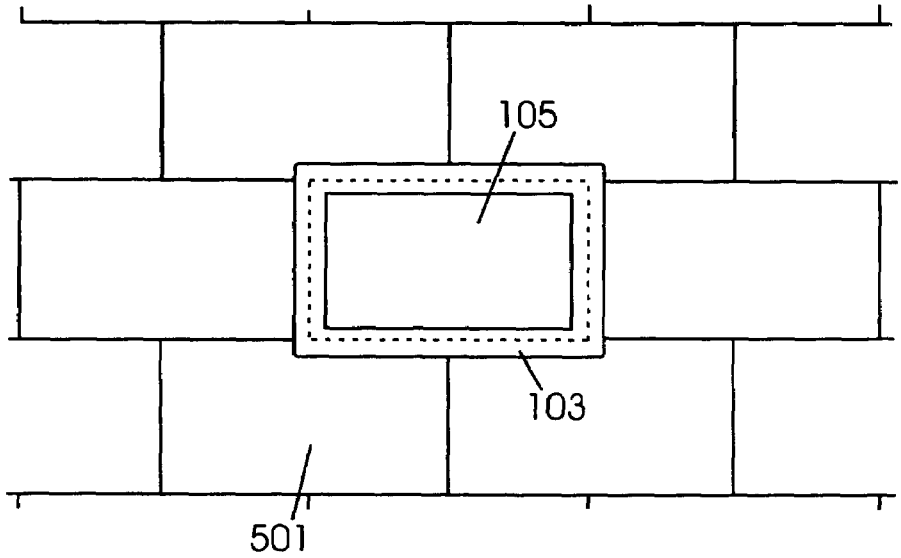
FIG. 5 illustrates an enclosure disposed in a wall in accordance with the invention.

An enclosure 101 is shown disposed in a wall 501 in FIG. 5. The cover plate 103 may advantageously extend horizontally and vertically beyond the edges or perimeter of the enclosure 101, such that a small amount of overlap is present between the enclosure 101 and the substructures of the wall adjacent to the enclosure 101. The overlap has several advantages, including allowing for inexact mating ("slop") in the interfaces 503 between the enclosure 101 and the substructures of the wall adjacent to the enclosure 101, thus saving construction time because the builders need not make the interfaces attractive or perfect. Although the cover plate 103 is shown in an embodiment in which fasteners, such as a plurality of screws, attach the cover plate 103 to the enclosure 101, the cover plate 103 may alternatively be attached to the enclosure 101 by one or more hinges and a snap lock or screw to prevent the cover plate 103 from moving unnecessarily.

Figure 6:
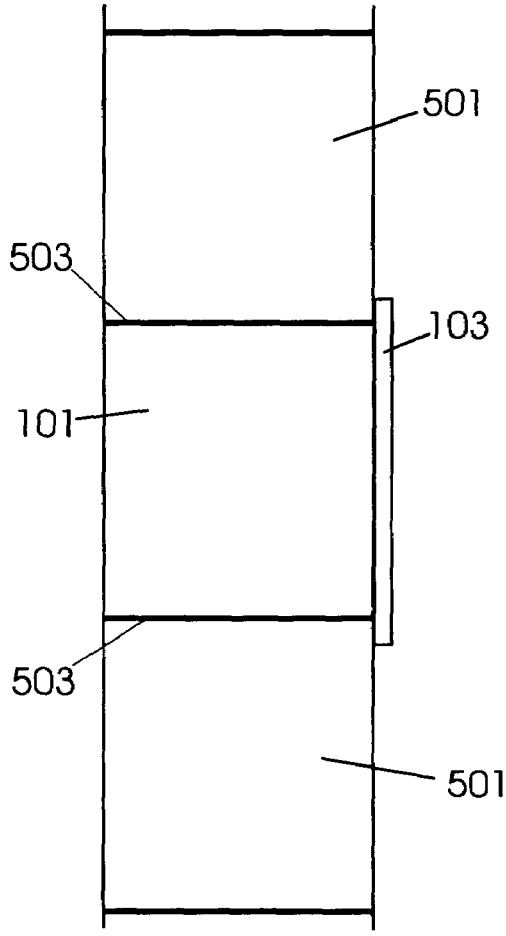
FIG. 6 is a cross-sectional view of an enclosure disposed in a wall in accordance with the invention.

The cover plate 103 may advantageously extend away from the wall 501, such as shown in the cross-section view of the enclosure 101 disposed in a wall 501 as shown in FIG. 6. Advantages include ease of installation of the enclosure 101, not requiring a perfect fit or clean interface between the enclosure 101 and the adjacent parts of the wall 501, and providing a gripping flange to hold the apparatus. If the cover plate 103 extends less than four inches from the wall 501, Americans with Disabilities Act standards for obstructions are met. Although the cover plate 103 is shown extending away from the wall 501, the cover plate 103 may alternatively have the same or smaller size as the outer edge of the enclosure 101, such that the enclosure 101 and cover plate 103 may be flush with the wall 501 or even recessed within the wall. Multiple cover plates 103 may be utilized. Cover plates 103 may be provided on different sides of the enclosure. For example, a cover plate 103 may be provided on the left side of the enclosure 101 and one on its right side as shown FIG. 6, such that the light source 201 provides light through two (or more) sides or ends of the enclosure. Light may be directed, for example through both sides of a wall, through both sides of a wall and out the end of the wall, or out all sides of a column. A single cover plate 103 may also be attached to two or more sides of the enclosure 101, for example, when the enclosure 101 is disposed at the corner of two walls or at the end of a self-standing wall.

Figure 7:
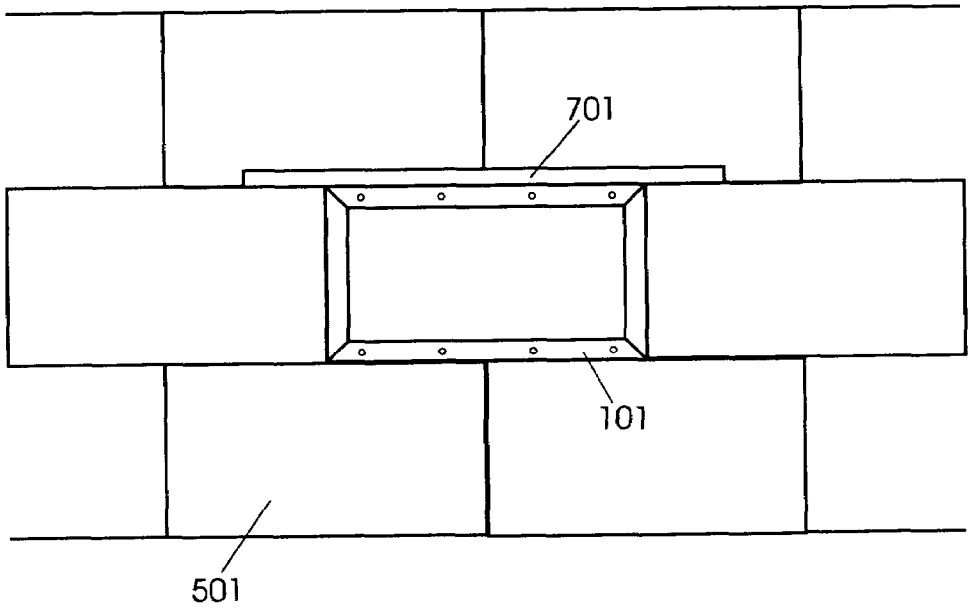
FIG. 7 illustrates an enclosure disposed in a wall with a support member in accordance with the invention.

An enclosure 101 disposed in a wall 501 with a support member 701 is shown in FIG. 7. The support member 701 may be, for example, a bar of reinforced steel that is welded or otherwise fastened to the enclosure 101 and disposed within the wall 501 such that the enclosure 101 resists removal from the wall 501 once installed.

A sheet of metal prior to being shaped into an enclosure 101 is shown in FIG. 8. The metal may be, for example, a metal capable of providing the desired support level, such as 14-gauge or 16-gauge galvanized carbon steel, which is also impact-resistant. The enclosure 101 advantageously comprised of a non-masonry material, such that it is more easily able to form any shape with any cavity, while providing a surface to which the light source 201, reflector 203, and any other devices may be readily mounted. The metal sheet 800 is folded along the fold lines 801, 803, 805, and 807 and welded at the seems 211 (as shown in FIG. 2) to form the desired shape. The enclosure 101 may alternatively be fastened together by ultrasonic welding, brazing, screws, rivets, chemical bonding, adhesives, and so forth. The metal sheet 800 may alternatively be cast, spun, punch pressed, and so forth. Instead of a single sheet, separate sections may be utilized and fastened together as described above. Although the enclosure 101 is shown with a rectangular shape, the enclosure may take on any shape. The enclosure 101 may be comprised of other materials than metal, including masonry material, and may be built utilizing other methods of construction than described herein.

An opening 809 is advantageously formed in the enclosure nearby the light source 201 to provide access for wiring to provide power to the light source 201. Alternatively, the sheet 800 may be shaped with a natural orifice through which the wiring may extend.

The present invention provides an enclosed light source that may be substantially flush with the wall or recessed such that it does not provide an obstacle, for example, to those walking near the wall. The enclosure provides support for the wall, thus additional support structures need not be provided. The light may be disposed at just about any level. Because the apparatus may be made to be resistant to impact, tampering, access, fire, and/or weather, the apparatus may be utilized in any wall, including those in public walkways, prisons, schools, residences, warehouses, offices, museums, and so forth.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus comprising:

an enclosure disposable in a wall such that the enclosure supports a part of the wall above the enclosure;

a cavity disposed within the enclosure, in which cavity a light source is disposable, such that light from the light source Illuminates at least one of an area adjacent to the wall and a part of the wall;

a support member mountable to the wall and to the enclosure, wherein the support member has a dimension larger than the enclosure, such that the apparatus resists removal from the wall.

2. The apparatus of claim 1, further comprising:

a cover plate attached to an end of the enclosure;

a lens disposed in the cover plate, such that light from the light source illuminates at least one of the area adjacent to the wall and the part of the wall.

3. The apparatus of claim 2, wherein the cover plate extends beyond an outer perimeter of the enclosure and extends away from the wall.

4. The apparatus of claim 2, wherein the cover plate is attached to the enclosure with at least one fastener having a non-standard interface to a fastening tool.

5. The apparatus of claim 1, wherein the enclosure is capable of providing substantially similar support as one or more substructures of the wall.

6. The apparatus of claim 5, wherein the one or more substructures are one or more of a concrete block, a cement block, a brick, and a cinder block.

7. The apparatus of claim 1, wherein the enclosure comprises at least one support that supports the part of the wall vertically.

8. The apparatus of claim 1, further comprising a lens through which light from the light source is capable of being emitted.

9. The apparatus of claim 1, wherein the enclosure is comprised of carbon steel.

10. The apparatus of claim 1, wherein the apparatus is disposed at least partially within the wall.

11. The apparatus of claim 1, wherein the apparatus is disposed wholly within the wall.

12. The apparatus of claim 1, further comprising at least one of impact-resistant material and access-resistant material.

13. The apparatus of claim 1, further comprising weather-resistant material.

14. The apparatus of claim 1, further comprising fire-resistant material.

15. The apparatus of claim 1, further comprising explosion-resistant material.

16. The apparatus of claim 1, wherein the enclosure is comprised of a non-masonry material.

17. An apparatus comprising;

an enclosure disposable in a wall and supporting a part of the wall above the enclosure;

a cavity disposed within the enclosure, in which cavity a light source is disposable, such that light from the light source illuminates at least one of an area adjacent to the wall and a part of the wall;

fire-resistant material disposed on the enclosure;

a support member mountable to the wall and to the enclosure and extending beyond the enclosure such that the apparatus resists removal from the wall.

18. A apparatus comprising:

an enclosure disposable in a wall such that the enclosure supports a part of the wall above the enclosure, and wherein the enclosure is comprised of a non-masonry material;

a cavity disposed within the enclosure, in which cavity a light source is disposable, such that light from the light source illuminates at least one of an area adjacent to the wall and a part of the wall;

a support member fastened to the enclosure, having at least one part extending beyond the enclosure, and mountable to the wall, such that the apparatus resists removal from the wall.

19. The apparatus of claim 18, further comprising:

a cover plate attached to an end of the enclosure;

a lens disposed in the cover plate, such that light from the light source illuminates at least one of the area adjacent to the wall and the part of the wall.

20. The apparatus of claim 19, further comprising a gasket disposed between the cover plate and the enclosure.

21. The apparatus of claim 19, wherein the cover plate is attached to the enclosure with at least one fastener having a non-standard interface to a fastening tool.

22. The apparatus of claim 18, wherein the enclosure is capable of providing substantially similar support as one or more substructures of the wall.

23. The apparatus of claim 22, wherein the one or more substructures are one or more of a concrete block, a cement block, a brick, and a cinder block.

24. The apparatus of claim 18, wherein the enclosure comprises at least one support that supports the part of the wall vertically.

25. The apparatus of claim 18, wherein the enclosure comprises at least two substantially vertical supports in conjunction with two substantially horizontal supports, thereby forming a substantially rectangular cavity.

26. The apparatus of claim 18, wherein the light source illuminates an area adjacent to a first side of the wall and an area adjacent to a second side of the wall, wherein the first side is not the same as the second side.

* * * * *